US008117949B2

(12) United States Patent
Huang

(10) Patent No.: US 8,117,949 B2
(45) Date of Patent: Feb. 21, 2012

(54) MOVABLE WRENCH

(75) Inventor: Ping Wen Huang, Wurih Township (TW)

(73) Assignee: New Way Tools Co., Ltd., Taichung (TW)

( * ) Notice: Subject to any disclaimer, the term of this patent is extended or adjusted under 35 U.S.C. 154(b) by 321 days.

(21) Appl. No.: 12/511,062

(22) Filed: Jul. 28, 2009

(65) Prior Publication Data

US 2011/0023665 A1 Feb. 3, 2011

(51) Int. Cl.
*B25B 13/16* (2006.01)

(52) U.S. Cl. ..... 81/165; 81/133; 81/157; 81/173

(58) Field of Classification Search ..... 81/133–136, 81/140, 157, 173, 165, DIG. 3
See application file for complete search history.

(56) References Cited

U.S. PATENT DOCUMENTS

| | | | | |
|---|---|---|---|---|
| 1,127,100 | A * | 2/1915 | Shuster | 81/165 |
| 1,391,251 | A * | 9/1921 | Ginsburg | 81/165 |
| 1,506,362 | A * | 8/1924 | Carman | 81/165 |
| 3,022,689 | A | 2/1962 | McComb | |
| 5,746,099 | A * | 5/1998 | Janson | 81/165 |
| 6,679,139 | B2 * | 1/2004 | Brenizer | 81/165 |
| 7,137,321 | B1 * | 11/2006 | Huang | 81/126 |

* cited by examiner

*Primary Examiner* — Debra S Meislin
(74) *Attorney, Agent, or Firm* — Wang Law Firm, Inc.; Li K. Wang

(57) ABSTRACT

A movable wrench including a screw bar, and an operating element. The bottom surface of the screw bar is urged by a first compressible spring. The hook part of the operating element urges against the bottom surface of the screw bar. As the user depresses the operating end of the operating element, the hook part escape from the bottom surface. The first compressible spring is depressed downward. After the reverse rotation and positioning, the first compressible spring urges against the screw bar again. The operating end is released so that the hook part urges against the bottom surface again.

6 Claims, 6 Drawing Sheets

MOVABLE WRENCH

BACKGROUND OF THE INVENTION

1. Field of Invention

The invention relates to a movable wrench and, in particular, to a wrench that is convenient in performing reciprocal rotations.

2. Related Art

Traditionally, one needs to adjust a roller before using a movable wrench so that the holding opening between its fixed jaw and movable jaw matches with the size of a screw nut in order to rotate it.

However, when space is limited, it is difficult to hold the wrench and rotate the nut continuously. Instead, one has to loosen the roller to enlarge the holding opening and snap another two opposite surfaces of the nut. This is rather inconvenient.

To solve the above-mentioned problem, U.S. Pat. No. 3,022,689 discloses a wrench, as shown in FIG. 7. It includes a holder 66 for the user to hold. One end of the holder 66 has a fixed jaw 68. One side of the fixed jaw 68 is provided with a movable jaw 62 that matches with a roller 61 and drives the movable jaw 62. The roller 61 is urged by a compressible spring 64 to provide the elastic force for the movable jaw 62 to locally move back and forth. The middle section of the holder 66 has an arc elastic chip 65. One end of the elastic chip 65 is fixed on the holder 66. The bottom of the other end has a protruding part 651 and connects with a spring lock 63. One end of the spring lock 63 extends to one side of the roller 61 and forms a stopping part 631, stopping the roller 61 from further moving. This fixes the opening between the fixed jaw 68 and the movable jaw 62 for the convenience of rotation jobs. When one presses the elastic chip 65 on the middle section of the holder 66, the blocking of the stopping part 631 of the spring lock 63 on the roller 61 is removed. The movable jaw 62 can freely move for the movable wrench to rotate reversely.

However, in practice, the movable wrench has the problems of unable to operate and incorrect touches. Please refer to FIG. 8. There is an obvious narrow long space 67 between the elastic chip 65 and the holder 66. After a long time of use, it will accumulate dusts and debris from the environment. This will make the elastic chip 65 stuck and it cannot be effectively depressed for normal operations.

As shown in FIGS. 7 and 8, the elastic chip 65 and the spring lock 63 are thin and long plates, both exposed from the wrench surface. When an external force is imposed thereon, the elastic chip 65 or the spring lock 63 is likely to be deformed. Once either one of them is deformed, the movable wrench no longer works.

Moreover, as shown in FIG. 9, one holds the holder 66 to exert a force when using the wrench. However, as the elastic chip 65 is located on one side surface of the holder 66, one may mis-trigger the elastic chip 65 when exerting a force. This is troublesome.

Moreover, the spring lock 63 is a long and thin plate. It connects to the elastic hip 65 by one end to support the stopping part 631 on the other end, so that the stopping part 631 can stop the roller 61. Therefore, the stopping part 631 of the spring lock 63 has a limited stopping effect on the roller 61. Once the wrench exerts a larger force on an object, the stopping part 631 of the spring lock 63 cannot stop the roller 61. In that case, the movable jaw 62 can still freely move and the wrench cannot tightly lock the object.

SUMMARY OF THE INVENTION

An objective of the invention is to solve the above-mentioned problems by providing a movable wrench. By changing the configuration of the operating end and the operating space, it can prevent dusts and impurities from falling in between. So the invention does not stuck because of this. It thus has a longer lifetime.

Another objective of the invention is to provide a movable wrench in which most of the operating element is disposed in an inner groove. This prevents the wrench from deforming due to collisions when it is put away inappropriately, thereby elongating its lifetime.

Yet another objective of the invention is to provide a movable wrench in which the bottom surface of the operating element urge against the bottom surfaces of the accommodating cavity and the inner groove. The operating element does not need to sustain a large pressure alone. This avoids the deformation problem.

A further objective of the invention is to provide a movable wrench in which the operating space is on the connecting part and in the vicinity of the holder. As the user rotates it, his palm would not incorrectly touch the operating end. This ensures work safety.

To achieve the above-mentioned objectives, the invention includes: a fixed jaw, a connecting part, a holder, a movable jaw, a screw bar, a first compressible spring, and an operating element. The fixed jaw and the movable jaw correspond to each other. The connecting part connects the fixed jaw, the movable jaw, and the holder. The screw bar is disposed at the connecting part. The operating element is pivotally disposed on the connecting part near the holder. The operating element and the screw bar have a locking relation. When the user's palm holds the holder, he can use his thumb to depress the operating element, thereby achieving locking and positioning effects.

BRIEF DESCRIPTION OF THE DRAWINGS

The invention will become more fully understood from the detailed description given herein below illustration only, and thus is not limitative of the present invention, and wherein.

DETAILED DESCRIPTION OF THE INVENTION

The present invention will be apparent from the following detailed description, which proceeds with reference to the accompanying drawings, wherein the same references relate to the same elements.

Figure 1:
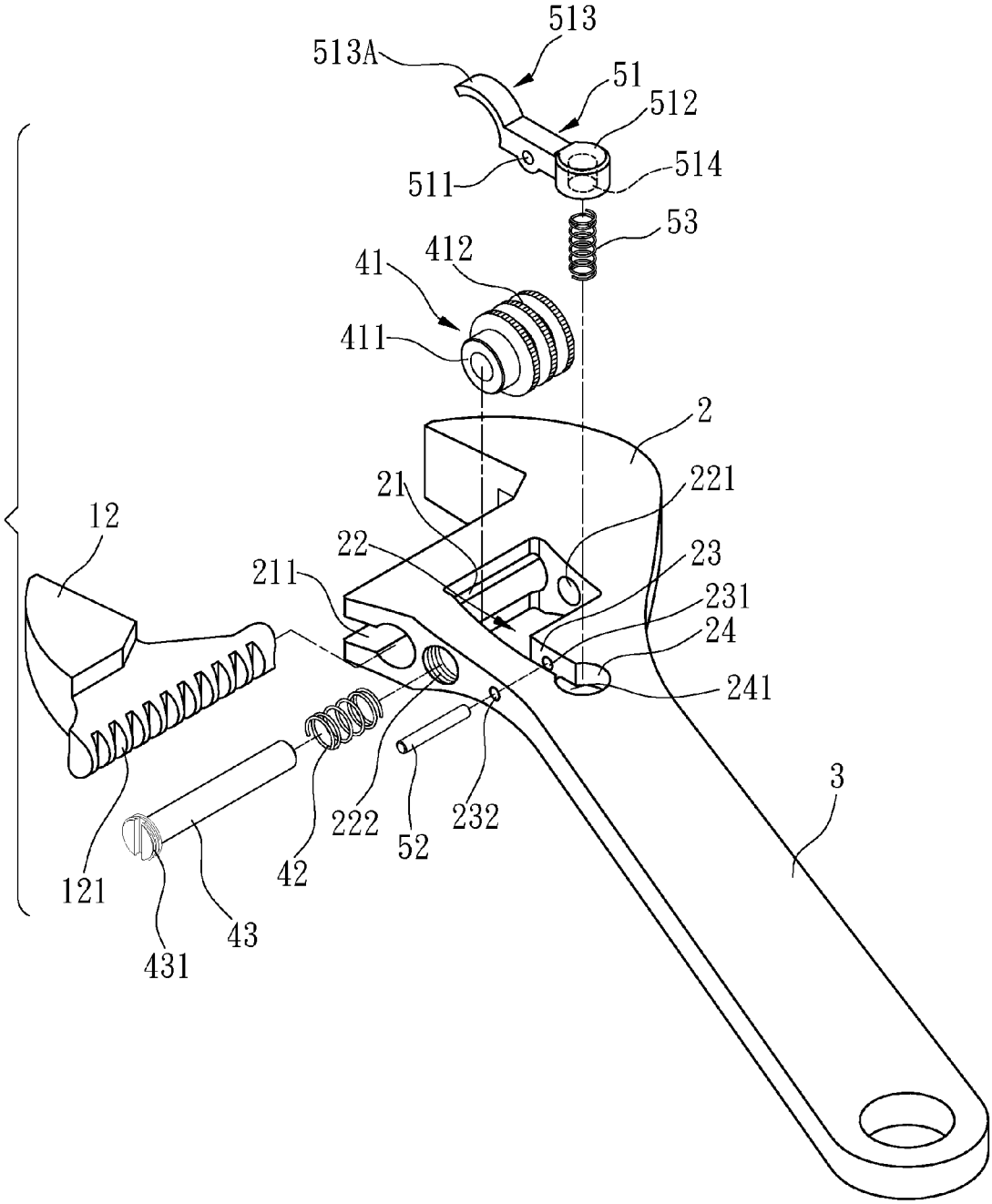
FIG. 1 is a three-dimensional exploded view of the invention.
Figure 2:
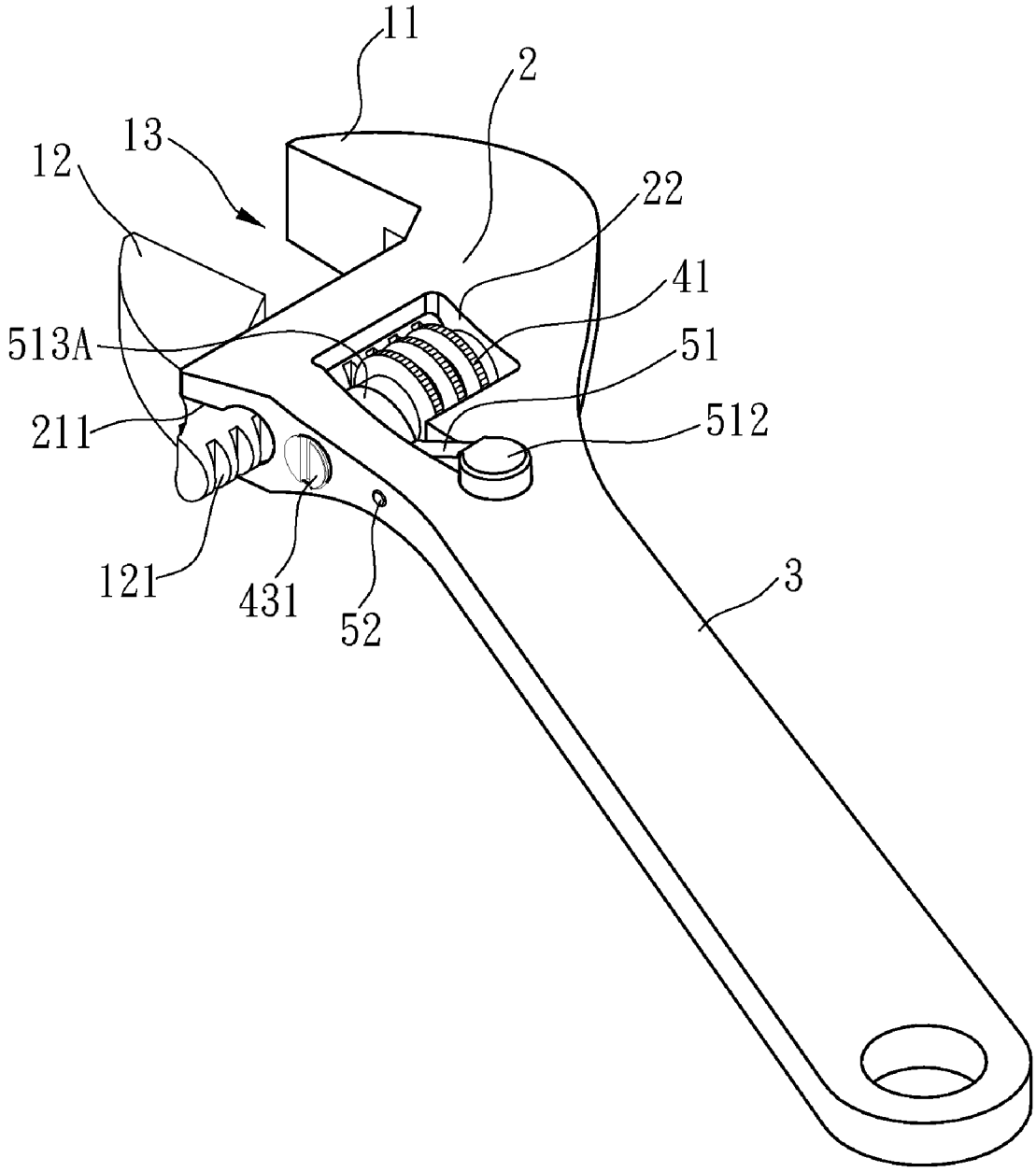
FIG. 2 is a three-dimensional assembly view of the invention.
Figure 3:
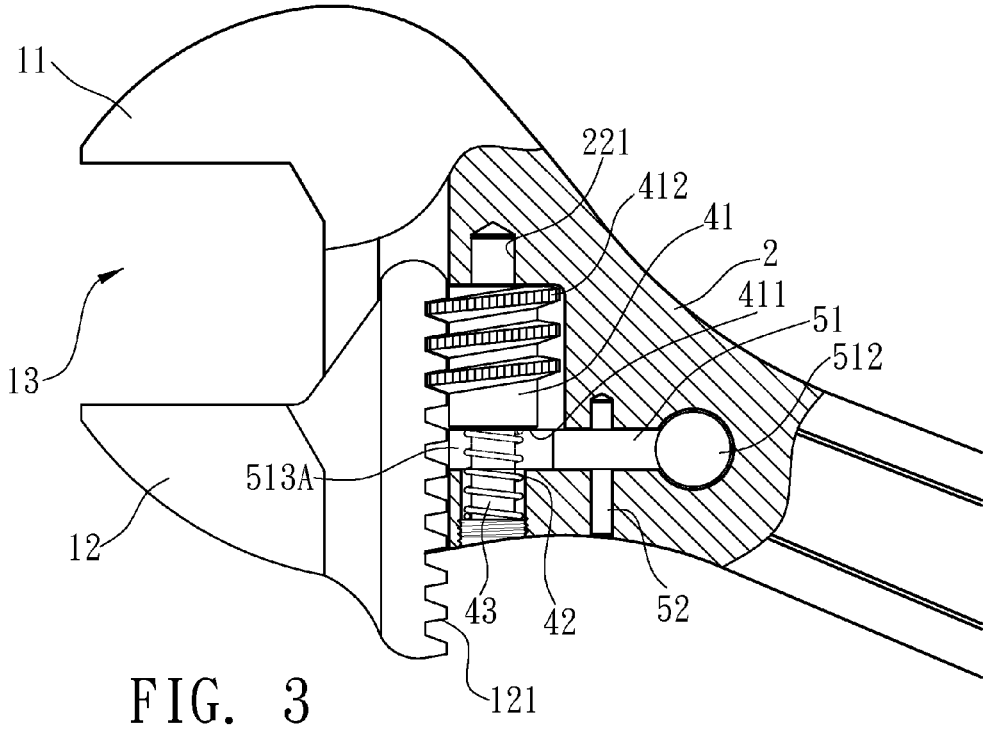
FIG. 3 is a side cross-sectional view of the connecting part in FIG. 2.

Please refer to FIG. 1 to 3. The following embodiment is a movable wrench, which includes a fixed jaw 11, a movable jaw 12, a screw bar 41, a first compressible spring 42, a shaft 43, an operating element 51, a pin 52, and a second compressible spring 53.

One side of the fixed jaw 11 is extended with a connecting part 2, which in turn is extended with a holder 3 away from the fixed jaw 11. One side of the connecting part 2 under the fixed jaw 11 is formed with a sliding track 21. In this embodiment, the sliding track 21 is formed with rectangular and round cross sections. The bottom surface of the connecting part 2 below the sliding track 21 is formed with an insertion opening 211.

The inner side surface of the sliding track 21 that faces the holder 3 is formed with a roughly rectangular accommodating cavity 22. Both side surfaces of the accommodating cavity 22 are penetrated through. The inner top and bottom surfaces of the accommodating cavity 22 are formed with a firs through hole 221 and a second through hole 222 whose diameter is larger than that of the first through hole 221. The second through hole 222 goes to the bottom surface of the connecting part 2.

From the sidewall of the bottom surface of the accommodating cavity 22 toward the holder 3 is extended with a narrow and long inner groove 23. The inner top and bottom surfaces of the inner groove 23 are respectively formed with a third through hole 231 and a fourth through hole 232, which correspond to each other. A round operating space 24 is formed on the end of the inner groove 23 away from the accommodating cavity 22. The operating space 24 is formed with an urging wall 241 along the longitudinal side surface. In this embodiment, the operating space 24 is located on the connecting part 2 and in the vicinity of the holder 3.

The movable jaw 12 is accommodated in the sliding track 21 via the insertion opening 211. It corresponds to the fixed jaw 11. The inner side of the movable jaw 12 has a long saw section 121 in the vicinity of one side of the accommodating cavity 22.

The screw bar 41 is disposed in the accommodating cavity 22. The top and bottom surfaces 411 of the screw bar 41 are penetrated through. The body of the screw bar has a thread section 412 that matches with the saw section 121 of the movable jaw 12.

The first compressible spring 42 goes below the connecting part 2. In this embodiment, the first compressible spring 42 goes into the second through hole 222. The top end of the first compressible spring 42 urges against the inner side of the bottom surface 411 of the screw bar 41.

The shaft 43 penetrates from the second through hole 222 under the connecting part 2. The shaft 43 goes through the first compressible spring 42 and the screw bar 41 in sequence and positions at the first through hole 221. The bottom end of the shaft 43 has a locking part 431, whose outer thread matches with the inner thread on the inner edge of the second through hole 222. The bottom end of the first compressible spring 42 urges against the locking part 431.

Most of the operating element 51 is disposed in the inner groove 23. The bottom surface of the operating element 51 urges against the bottom surfaces of the accommodating cavity 22 and the inner groove 23 as a support. The middle section of the operating element 51 has a connecting hole 511 corresponding to the third through hole 231 and the fourth through hole 232. Both ends of the operating element 51 have an operating end 512 and a locking end 513, respectively. The bottom part of the operating end 512 has a concave hole 514. The operating end 512 is round and located in the round operating space 24 to keep dusts and impurities out. In this embodiment, the operating end 512 slightly protrudes from the opening of the operating space 24 for depressing.

The locking end 513 is near the bottom surface of the accommodating cavity 22. It has a hook part 513A whose top surface urges against the bottom surface 411 of the screw bar 41 near its outer side and surrounds the outer side of the first compressible spring 42.

The pin 52 goes from underneath the inner groove 23 of the connecting part 2 through the operating part 51. In this embodiment, the pin 52 penetrates in sequence through the fourth through hole 232, the connecting hole 511, and the third through hole 231 to position the operating element 51. The operating element 51 rotates with respect to the pin 52.

The second compressible spring 53 is disposed in the operating space 24. It bottom end urges against the urging wall 241. The top end of the second compressible spring 53 urges against the bottom part of the operating end 512. In this embodiment, the top end of the second compressible spring 53 urges against the concave hole 514 of the operating end 512 for positioning.

In practice, as shown in FIG. 3, a holding opening 13 is formed between the fixed jaw 11 and the movable jaw 12. One can control the size of the holding opening 13 by rotating the screw bar 41 that in turn drives the movable jaw 12.

Figure 4:
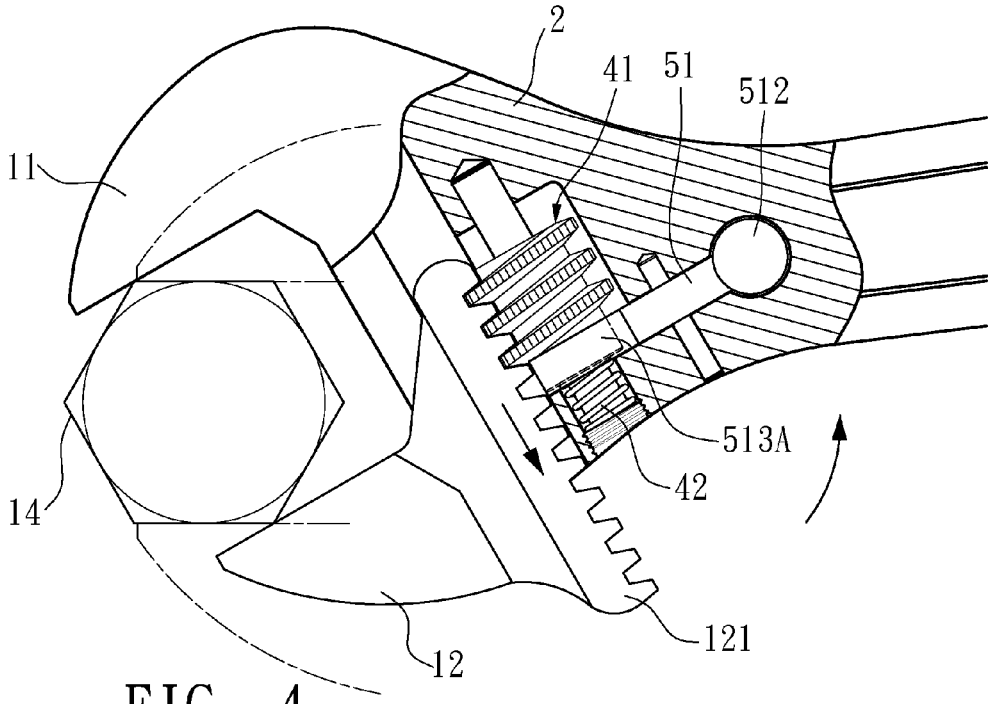
FIG. 4 is a side schematic view of the wrench in FIG. 3, where the movable jaw moves downward and drives the screw bar to depress the first compressible spring as the wrench rotates.
Figure 5:
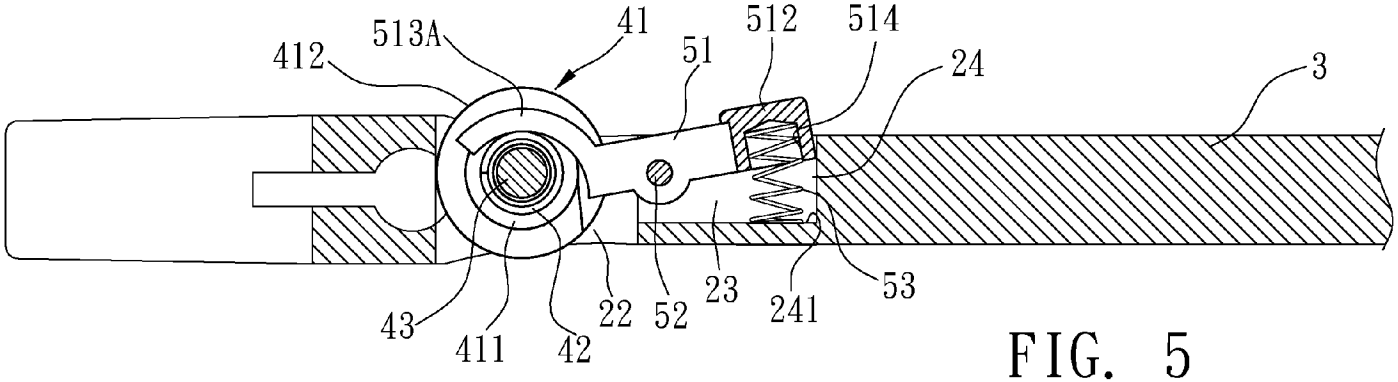
FIG. 5 is a schematic view of the operating element as viewed from another perspective.
Figure 6:
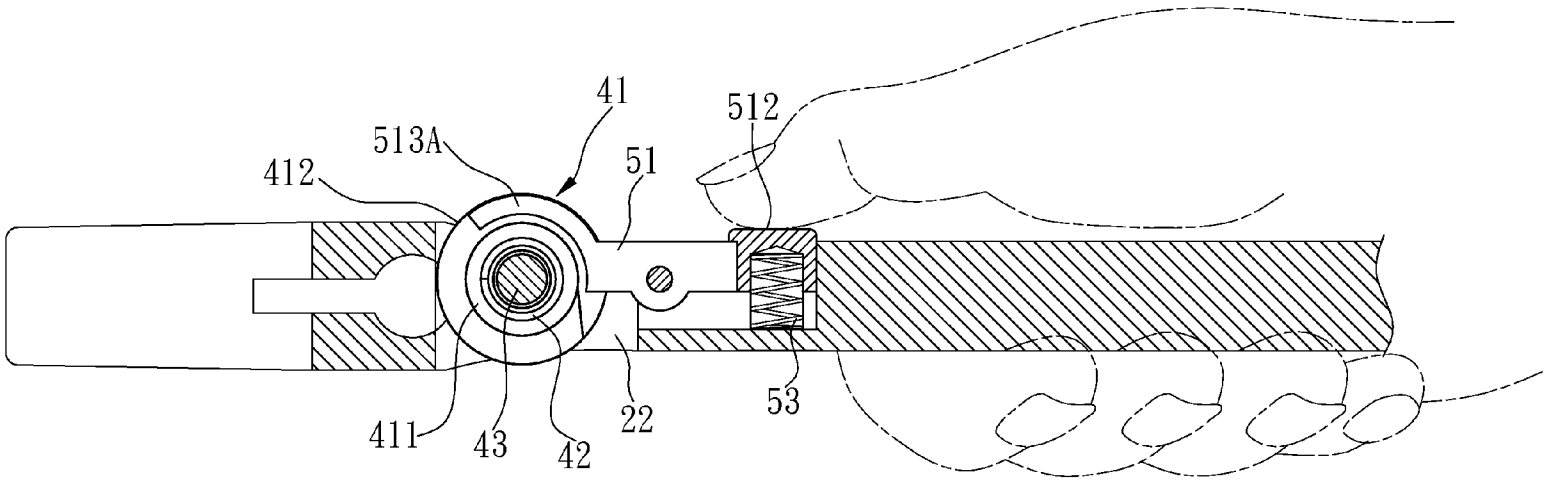
FIG. 6 is a schematic view of the escaping hook part when the operating end is depressed.
Figure 7:
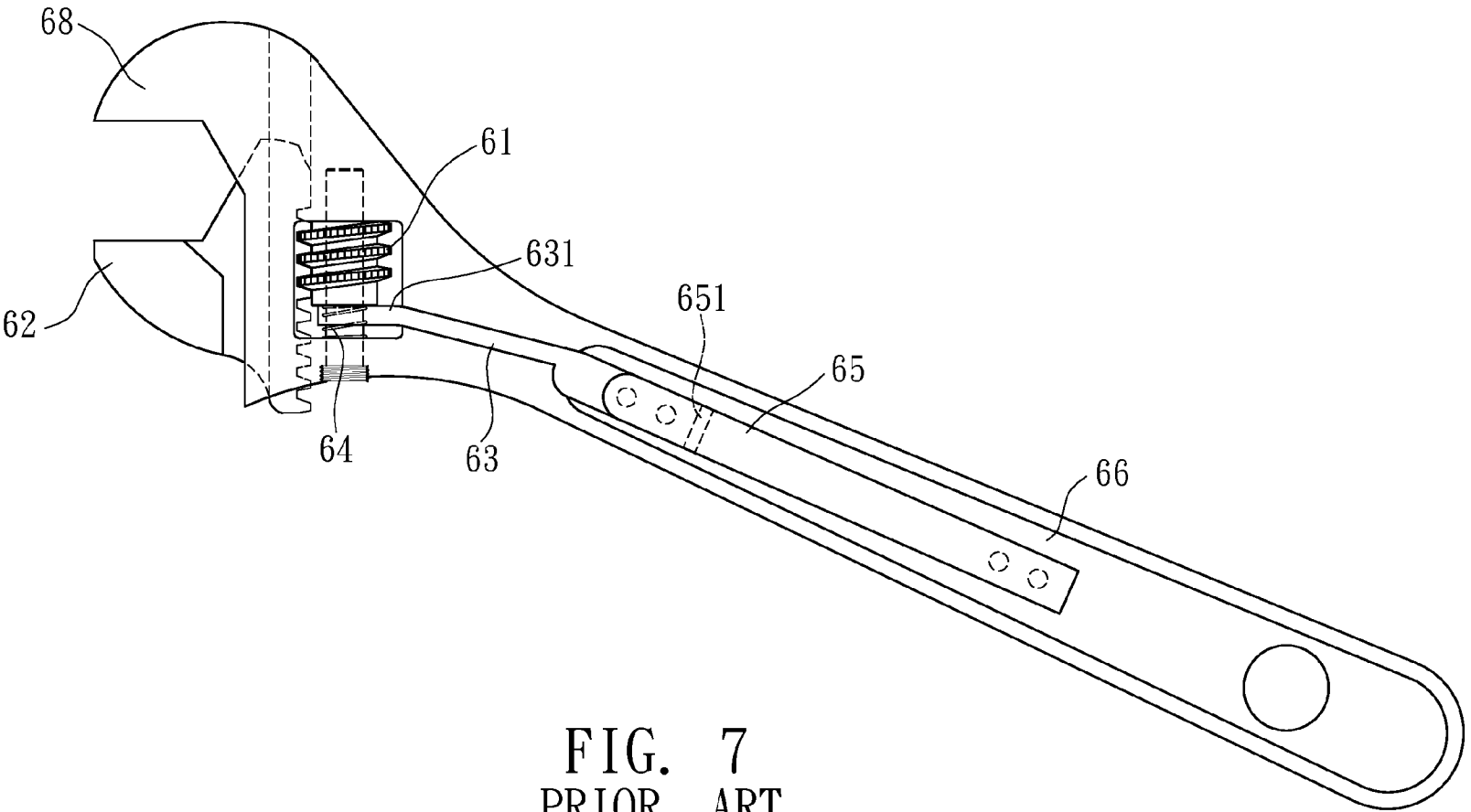
FIG. 7 PRIOR ART
FIG. 7 is a planar view of a conventional wrench.
Figure 8:
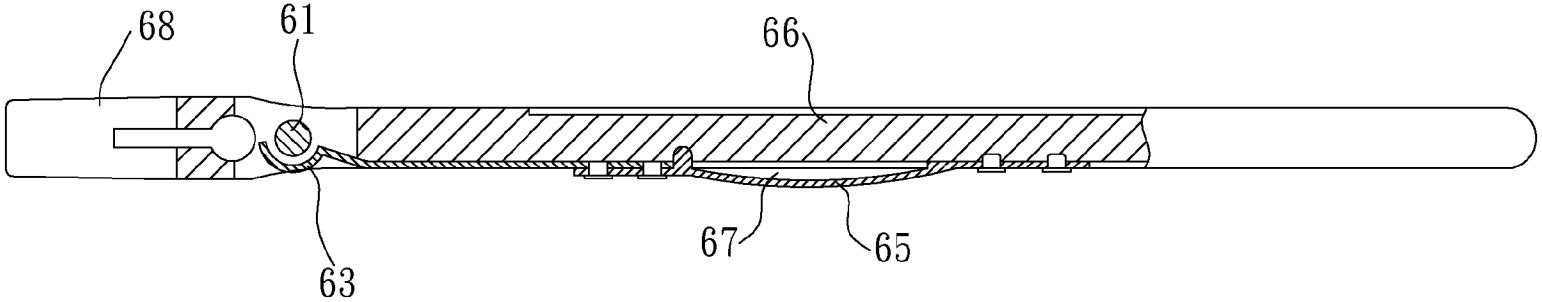
FIG. 8 PRIOR ART
FIG. 8 is another planar view of the conventional wrench.
Figure 9:
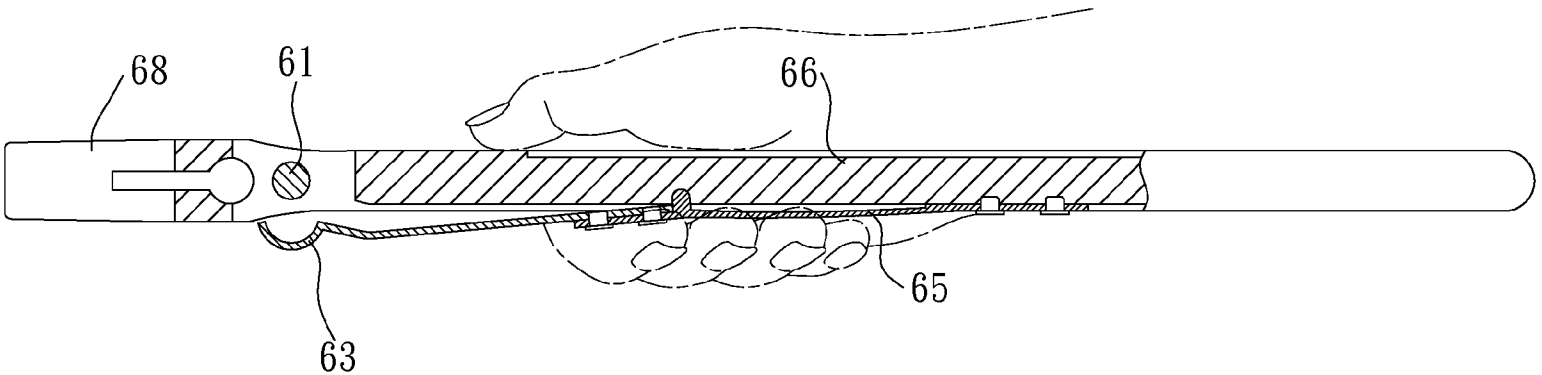
FIG. 9 PRIOR ART
FIG. 9 is a schematic view showing that the elastic chip of the wrench in FIG. 8 is erroneously touched.

Moreover, when rotating and fastening (loosening) the screw nut 14 (including other similar elements), the user holds the holder 3 by hand. The position of the hook part 513A of the operating element 51 is as shown in FIG. 4. As the user holds and rotates, the screw bar 41 experiences a downward force due to the movable jaw 12. The top surface of the hook part 513A urges against the bottom surface 411 of the screw bar 41. The bottom surface of the hook part 513A urges against the bottom surfaces of the accommodating cavity 22 and the inner groove 23. The support at these two places renders a more stable screw bar 41, providing a better operating effect.

To rotate the wrench in reverse, the user uses his thumb to depress the operating end 512. The hook part 513A on the locking end 513 of the operating element 51 escapes from the bottom surface 411 of the screw bar 41. The bottom surface 411 of the screw bar 41 is only urged by the first compressible spring 42. Since the diagonal distance of the two opposite angles of the screw nut 14 is wider than the distance between the original two opposite holding surfaces, the holding opening 13 is pushed out by the two opposite angles during the reverse rotation. At the same time, the movable jaw 12 moves downward and drives the screw bar 41 to depress the first compressible spring 42. When the wrench rotates to the other two opposite holding surfaces of the screw nut 14, the distance between the two opposite holding surfaces of the screw nut 14 is narrower than the distance of the diagonal line between two opposite angles, the first compressible spring experiences a smaller force now. It thus pushes the screw bar 41 upward and drives the movable jaw 12 to reduce the holding opening 13. In this case, the user removes his thumb from the operating end 512 of the operating element 51 to release the depressing state. The second compressible spring 53 in the operating space 24 then urges against the operating end 512, so that the hook part 513A on the locking end 513 of the operating element 51 returns to its original position. That is, the top surface of the hook part 513A urges against the bottom surface 411 of the screw bar 41 again. These fastening and loosening processes are performed repeatedly to increase work efficiency.

In summary, in addition to the advantage of fast operations, the disclosed movable wrench has the following advantages as well:

1. The configuration of the operating end and the operating space is such that dusts and impurities are kept out. This prevents the invention from getting stuck and elongates its lifetime.

2. Most of the operating element is disposed in the inner groove. This prevents the operating element from being deformed due to collisions when one put away the movable wrench inappropriately.

3. The bottom surface of the operating element urges against the bottom surfaces of the accommodating cavity and the inner groove. The support from the bottom surfaces of the accommodating cavity and the inner groove prevents the operating element from experiencing too large a pressure and deformation.

4. The operating space is formed on the connecting part and in the vicinity of the holder. When the user rotates it, this space prevents the user's palm from erroneously touching the operating end, ensuring work safety.

Although the invention has been described with reference to specific embodiments, this description is not meant to be construed in a limiting sense. Various modifications of the disclosed embodiments, as well as alternative embodiments, will be apparent to people skilled in the art. Therefore, it is contemplated that the appended claims will cover all modifications that fall within the true scope of the invention.

What is claimed is:

1. A movable wrench comprising:

a fixed jaw, whose one side has a connecting part extended with a holder; wherein one side of the connecting part has a sliding track with an inner side surface, an insertion opening is formed under the sliding track, the inner side surface of the sliding track has an accommodating cavity whose bottom surface is extended and formed with an inner groove toward the holder, the end of the inner groove away from the accommodating cavity is formed with an operating space whose side surface is an urging wall;

a movable jaw, which is inserted into the sliding track via the insertion opening and has a saw section on its inner side near one side of the accommodating cavity;

a screw bar, which is disposed in the accommodating cavity with its top surface and bottom surface being penetrated through and has a thread section on its body, the thread section matching with the saw section on the movable jaw;

a first compressible spring, which goes through the connecting part with its top end urging against the bottom surface of the screw bar;

a shaft, which goes through the first compressible spring and the screw bar under the connecting part;

an operating element, which is disposed in the inner groove and urges against the bottom surfaces of the accommodating cavity and the inner groove, both ends of the operating element are respectively an operating end and a locking end, wherein the operating end is in the operating space, the locking end is near the bottom surface of the accommodating cavity, the locking end has a hook part with a top surface, and the top surface of the hook part urges against the bottom surface of the screw bar and surrounds the first compressible spring;

a pin, which goes through the operating element under the inner groove of the connecting part, wherein the operating element rotates with respect to the pin; and a second compressible spring, which is disposed in the operating space with its bottom end urging against the urging wall and its top end urging against the bottom part of the operating end.

2. The movable wrench of claim 1 characterized in that the top surface and the bottom surface on the inner side of the accommodating cavity have a first through hole and a second through hole, respectively, that the second through hole penetrates to the bottom surface of the connecting part, that the first compressible spring is disposed in the second through hole, that the shaft penetrates via the second through hole and positions at the first through hole, that the bottom end of the shaft has a locking part locking onto the inner edge of the second through hole, and that the bottom end of the first compressible spring urges against the locking part.

3. The movable wrench of claim 1 characterized in that the top surface and the surface on the inner side of the inner groove have a third through hole and a fourth through hole, respectively, that the middle section of the operating element has a connecting hole corresponding to the third through hole and the fourth through hole, and that the pin goes through in sequence the fourth through hole, the connecting hole, and the third through hole for the operating element to position.

4. The movable wrench of claim 1 characterized in that the bottom part of the operating end of the operating element has a concave hole against which the top end of the second compressible spring urges.

5. The movable wrench of claim 1 characterized in that the operating end is located in the operating space and slightly protrudes from the opening thereof.

6. The movable wrench of claim 1 characterized in that the operating space is formed on the connecting part in the vicinity of the holder.

* * * * *